United States Patent [19]

Svensson

[11] Patent Number: 4,738,058

[45] Date of Patent: Apr. 19, 1988

[54] POST

[76] Inventor: Lars Svensson, Vikingavägen 112, S-186 00 Vallentuna, Sweden

[21] Appl. No.: 36,683

[22] Filed: Feb. 17, 1987

[30] Foreign Application Priority Data

Jun. 18, 1985 [SE] Sweden ..... 8503034

[51] Int. Cl.[4] ..... E01F 9/01

[52] U.S. Cl. ..... 52/98; 52/223 R; 52/730

[58] Field of Search ..... 52/98, 223, 228, 227, 52/730; 404/10

[56] References Cited

U.S. PATENT DOCUMENTS 973,670 10/1910 Kinnear ..... 52/223 R 3,987,593 10/1976 Svensson ..... 52/98

4,630,413 12/1986 Svensson ..... 52/98

*Primary Examiner*—Henry E. Raduazo

*Attorney, Agent, or Firm*—Browdy and Neimark

[57] ABSTRACT

The present invention relates to a post comprising a hollow elongated body (1) and rods (2) adapted for static cooperation therewith and so interconnected that said cooperation is interrupted when the post is subjected to local transverse stresses of a predetermined magnitude.

The novel features of the invention reside in that the hollow body (1), which is manufactured by extrusion, is provided with a number of per se known internal grooves (5) forming rupture lines and, at least two inwardly open channels (8) defined by inwardly projecting tongues (7), and in that the rods (2) are accommodated in the channels (8), suitably under prestress.

5 Claims, 3 Drawing Sheets

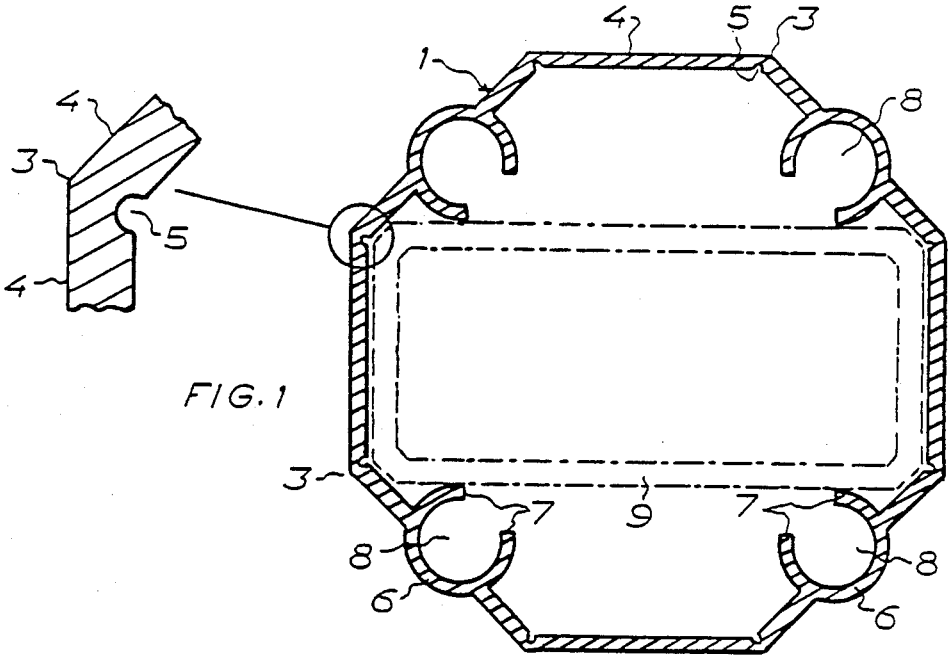
FIG. 1
FIG. 3
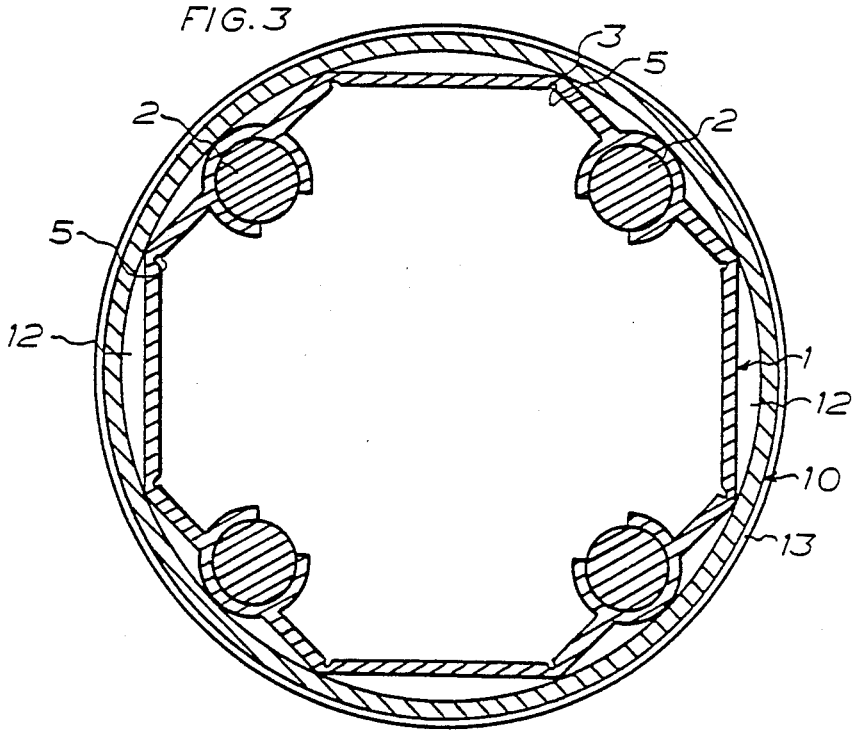

POST

This is a continuing application of copending parent PCT//SE86/00281, the international filing date of which was June 11, 1986.

The present invention relates to a post of the type stated in the main claim.

Swedish Pat. No. 389,705 discloses a post which is intended to be given a considerable height and which consists of a body of a relatively thin material and rods of steel or like material arranged in the body. The rods are preferably intermittently fixed to the body by spot welding or the like. This prior art post has an excellent capacity of taking up static loads and a quite unique capability of yielding when hit by a vehicle in that the connection between the body and the rods, normally forming a static unit, is broken, the post offering but a slight resistance.

Swedish Patent Application No. 8301967-9 discloses a post which is preferably manufactured by extrusion and preferably intended for medium heights. This post has a polygonal cross-section and is provided with grooves along the inner sides of the corners. By the provision of such grooves, the impression of one side of the body occasioned by a vehicle hitting the post will entail that the deformation of the post is concentrated in the grooves and the corners will be ruptured. Finally, there is produced a lever effect promoting such rupture in that the edges of the grooves are brought into contact with each other.

The object of the present invention is to provide, on the basis of currently existing posts, a high post which can be manufactured by extrusion, which has hitherto been impossible with a reasonable consumption of material, and yet offers sufficient stability while affording at the same time the substantial advantages inherent in the capability of the post of readily yielding when hit by a vehicle. Also, the post should be so conceived that it can be easily mounted instead of a conventional solid tubular steel post.

The essential novel features of the post according to the invention appear from the characterizing clause of the main claim.

Figure 2:
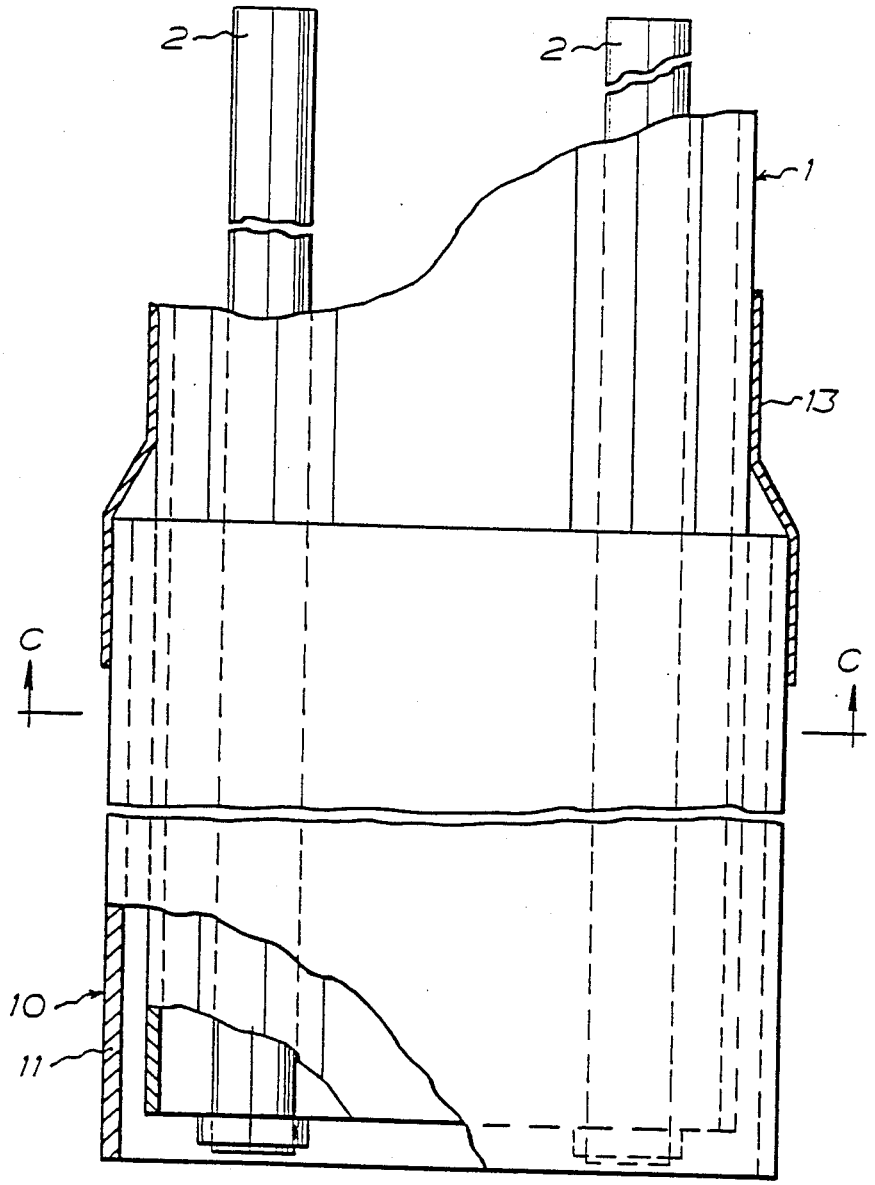
Figure 4:
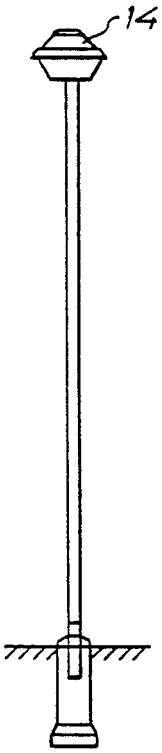
Figure 5:
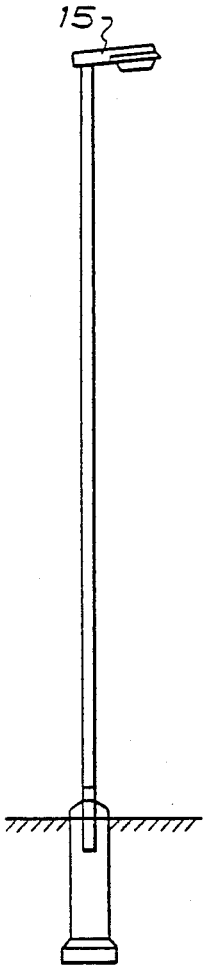

The post according to the invention will be described in greater detail hereinbelow with reference to the accompanying drawings in which FIG. 1 is a cross-section of the profile forming the body of the post, FIG. 2 is an axial section of the lower end of a post mounted in an existing base, FIG. 3 is a cross-section taken along the line C—C in FIG. 2, and FIGS. 4–5 illustrate on a smaller scale a few conceivable embodiments of posts.

Like the post disclosed in the above-mentioned patent, the post according to the present invention consists of a body 1 and a number of rods 2. The body is polygonal, suitably octagonal, but other shapes may exist. Like the post according to the above-mentioned patent application, the corners 3 between the sides 4 are provided with internal grooves 5. In some of the sides, preferably every other side, there is provided a channel integrally formed with the rest of the side and comprising a bulging portion 6 in the side itself and two tongues 7 which arcuately project inwardly towards the interior of the body 1. The channels 8 accomodate the rods 2 which are partially surrounded by the tongues 7 and inserted in place under prestress. In FIG. 1, the dashed lines indicate a connecting piece 9 for interconnecting two body sections.

In connection with the mounting of the rods in the channels, there may be applied a binder, glue or the like adhering to the material of the elements and supplementing the force of retention exerted by the prestress of the tongues. By using a binder or the like, it is possible to slightly reduce the peripheral enclosure of the rods by the tongues, which makes it easier to mount the rods in the channels.

Since the extruded body 1 in itself has good stability, it is often unnecessary to provide rods 2 throughout the entire length of the post. Thus, in many cases, it is sufficient with rods extending only a certain distance upwards from the base of the post.

The body 1 and the rods 2 cooperate statically in order to take up e.g. stresses from fittings supported by the post, wind load and the like. However, when the post is subjected to substantial local stress in the transverse direction, the affected side of the post will be impressed such that, because of the "hinge action" produced at adjoining corners, the sides adjoining the affected side of the post will be pressed outwardly, thereby increasing the width of the post transversely of the direction of impact, whereupon the corners 3 will be gradually ruptured. While this is taking place, the deformation of the sides of the post will entail that the rods 2 are urged out of the channels 8, which finally results in that the post, commencing at the portion hit by the vehicle, will gradually collapse without exerting any lifting action on the vehicle. Since the collapsed portion of the post is not capable of taking up any vertical load, an increasing part of the post will gradually collapse while the vehicle remains in the same vertical position.

In FIGS. 2 and 3, it is shown how a post according to the invention can be mounted in a base 10 which may consist of the remaining part of a conventional post that has been cut. The octagonal body 1 is simply inserted in the casing 11 of the base and fixed by means of a suitable hardenable substance 12. In order to achieve adequate sealing, a sleeve 13 is provided over the joint.

Figure 6:
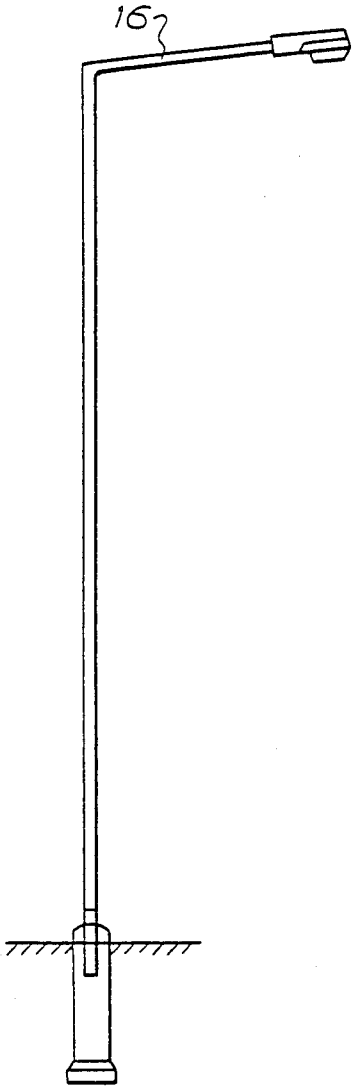

As appears from FIGS. 4–6, the post according to the invention can be given different heights with lamp fittings 14 mounted directly on the post or by means of a short or a long arm 15 and 16 carrying the lamp fittings.

As mentioned in the introduction to the specification, the body need not be octagonal but may have any other suitable shape. Also, the rods may have a cross-section other than a round one.

In some cases, a rectangular cross-section may be preferable since it is then not necessary to rely on the elasticity of the tongues 7 for retaining the rods 2. In fact, with rectangular rods, corresponding tongues are provided parallel to the radius to the centre of the channel and are formed with an inwardly directed edge flange retaining the rod by snap action.

The novel post which because of the manufacture by extrusion is given an unconventional design with a constant cross-section can be used both for road and street lighting purposes and as shorter posts used in parks.

The invention should of course not be considered restricted to what has been described above and illustrated in the drawings but may be modified in several different ways within the scope of the accompanying claims.

I claim:

1. A post comprising a hollow elongated body (1) and rods (2) adapted for static cooperation therewith and so interconnected that said cooperation is interrupted when the post is subjected to local transverse stresses of predetermined magnitude, characterized in that the hollow body (1) which is manufactured by extrusion, is provided with a number internal grooves (5) forming rupture lines, and at least two inwardly open channels (8) defined by inwardly projecting tongues (7), and further characterized in that the rods (2) are accommodated in said channels (8) under prestress.

2. Post as claimed in claim 1, characterized in that the body (1) is essentially polygonal and that the rupture lines forming grooves (5) are provided in corners between adjacent sides of said polygonal body.

3. Post as claimed in claim 1, characterized in that the rods (2) extend along a limited portion of the length of the post.

4. Post as claimed in claim 1, characterized in that the channels (8), in addition to the inwardly projecting tongues (7), are defined by an outwardly curved portion (6) of the wall (4) of the post, the cross-section of the rods (2) being intersected by the plane of the wall.

5. Post as claimed in claim 1, characterized in that the rods are secured in the channels (8) by means of a binder, glue or the like.

* * * * *